United States Patent [19]

Hahn

[11] Patent Number: 4,744,478

[45] Date of Patent: May 17, 1988

[54] PLASTIC CLOSURE WITH UNITARILY MOLDED, FOAMED SEALING LAYER

[75] Inventor: Granville J. Hahn, Big Spring, Tex.

[73] Assignee: Permian Research Corporation, Big Spring, Tex.

[21] Appl. No.: 922,127

[22] Filed: Oct. 23, 1986

[51] Int. Cl.[4] ..... B65D 53/00

[52] U.S. Cl. ..... 215/252; 215/329; 215/347; 215/348

[58] Field of Search ..... 215/329, 341, 344, 347, 215/348, 252

[56] References Cited

U.S. PATENT DOCUMENTS

| | | | |
|---|---|---|---|
| 1,427,133 | 8/1922 | Taliaferro | 215/348 |
| 1,898,342 | 2/1933 | Cuthbert | 215/329 |
| 3,061,130 | 10/1962 | Husum | 215/347 |
| 3,896,959 | 7/1975 | Roy | 215/348 X |
| 4,383,620 | 5/1983 | Mumford | 215/329 |
| 4,407,422 | 10/1983 | Wilde et al. | 215/329 X |

*Primary Examiner*—Donald F. Norton

*Attorney, Agent, or Firm*—Ross & Howison

[57] ABSTRACT

A molded polymeric container closure comprising at least one substantially unfoamed polymer layer and an integrally molded foamed layer of the same polymer.

12 Claims, 2 Drawing Sheets

PLASTIC CLOSURE WITH UNITARILY MOLDED, FOAMED SEALING LAYER

TECHNICAL FIELD

This invention relates to plastic closures, and more particularly, to plastic closures for glass or plastic containers. One aspect of the invention relates to a one-piece, injection molded, plastic closure for carbonated beverage bottles. Another aspect of the invention relates to a container closure comprising a unitarily molded, foamed polymeric sealing layer. A further aspect of the invention relates to a plastic container closure having a foamed sealing layer that is formed in situ.

BACKGROUND OF THE INVENTION

Plastic container closures and, more particularly, plastic closures for carbonated beverage bottles having threaded necks are well known, having previously been disclosed, for example, in U.S. Pat. Nos. 4,310,101; 4,326,639; 4,394,918; 4,461,391; and 4,476,987. Such closures typically employ sealing discs and/or molded flanges which contact the bottle lip to reduce the loss of carbonation. Used alone, integrally molded plastic flanges have not provided the desired sealing characteristics. Although sealing discs have proved to be quite effective for reducing loss of carbonation, they are separately manufactured and inserted into a molded bottle cap, thereby increasing both the time and expense required to produce a satisfactory closure. A unitarily molded plastic bottle cap having satisfactory sealing characteristics is therefore needed.

Problems have also been encountered in manufacturing plastic closures for containers adapted to thermally insulate their contents. Such containers frequently employ plastic closures which provide sealing engagement with the lip, rim or wall of the container by means of a friction fit. This friction fit is typically achieved by means of molded threads, tapered surfaces, or separately made compressible gaskets. In order to reduce thermal conductivity through the body of such plastic closures, manufacturers have in many instances molded closures comprising an internal cavity into which a dissimilar foamed insulating material is subsequently injected. A plastic closure is therefore needed that is unitarily molded and comprises a foamed polymeric insulating core bounded by nonfoamed, outwardly-facing surface layers.

In U.S. Pat. No. 3,721,197, a one-piece plastic wad structure for use with a shotshell is formed by injecting a molten mixture of a resinous material and a foaming agent into a mold cavity, cooling the injected mixture so as to partially solidify the mixture in the cavity, and then reducing pressure in the cavity by enlarging its volume to permit a portion of the injected mixture to foam in situ.

SUMMARY OF THE INVENTION

According to the present invention, an improved polymeric container closure is provided that comprises a unitarily molded, foamed, polymeric sealing layer. According to one embodiment of the invention, a plastic bottle cap is provided that is adapted to provide sealing engagement with the threaded neck of either a glass or plastic bottle. According to another embodiment of the invention, the subject bottle cap is threaded and further comprises a pilfer ring adapted to provide evidence of tampering if the cap is opened prior to consumption by the end-user.

According to a preferred embodiment of the invention, a molded thermoplastic bottle cap is provided that comprises a disc or annulus of foamed polymer unitarily molded between two higher density layers of the same polymer. The layer of foamed polymer is adapted to provide sealing engagement between the downward facing, interior surface of the bottle cap and the upward-facing edge of the bottle neck.

According to another embodiment of the invention, a unitarily molded plastic container closure is provided that comprises an inside layer of foamed polymer confined by nonfoamed outside walls of the same polymer. Molded closures of this type provide excellent insulating properties, and can be manufactured more simply and economically than coventional insulated closures.

A preferred embodiment of the plastic closure of the invention is further described and explained in reference to the following drawings wherein.

Like numerals are used to describe like parts in all figures of the drawings.

Figure 1:
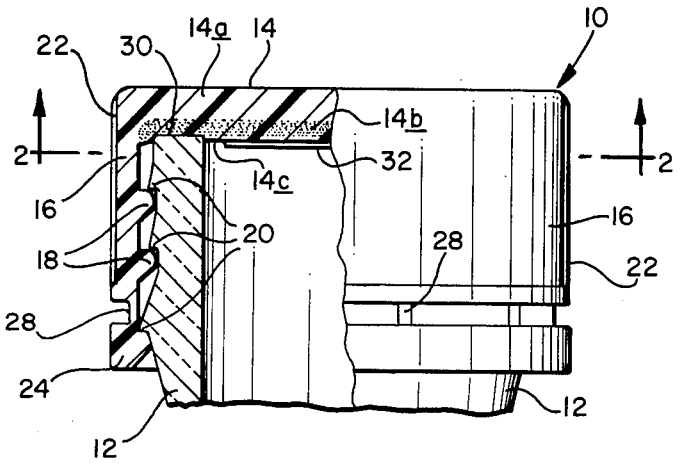
FIG. 1 is a front elevation view, partially in section, of the bottle cap of the invention applied to the neck of a bottle.

Referring to FIG. 1, bottle cap 10 is depicted in threaded engagement with bottle neck 12. For ease of illustration, the remainder of the bottle is broken away. Similarly, in the left half of FIG. 1, a portion of bottle cap 10 and bottle neck 12 are broken away to depict a partial sectional view. The bottle caps of the invention are successfully utilized with bottles made of either glass or plastic.

Bottle cap 10 preferably comprises circular end wall 14 and circumferentially extending side wall 16. In accordance with the present invention, end wall 14 preferably further comprises foamed polymer layer **14*b* sandwiched between two relatively denser layers 14*a*, 14*c* of the same polymer. Layer 14*a* is the primary structural layer of end wall 14 and is desirably molded together with side wall 16** to provide a strong, continuous closure capable of withstanding pressures characteristic of the pressures encountered in sealing carbonated beverage containers.

The inwardly facing surface of side wall 16 preferably further comprises molded threads 18 which engage threads 20 of bottle neck 12. A plurality of circumferentially spaced ribs 22 are optionally provided on the outwardly facing surface of side wall 16 to assist the consumer in gripping bottle cap 10, although it will be understood by those of skill in the art upon reading this disclosure that knurling or other surface texturing can similarly be imparted to the outwardly facing surface of side wall 16 during the molding process for that purpose.

According to a preferred embodiment of the invention, bottle cap 10 further comprises pilfer ring 24 which engages shoulder 26 of bottle neck 12. Pilfer ring 24 is desirably molded together with end wall 14 and side wall 16 of bottle cap 10, and is connected to the lower portion of side wall 16 by a plurality of relatively narrow, circumferentially spaced thermoplastic bridges 28 that are adapted to fail in tension when side wall 16 is rotated so as to remove bottle cap 10 from bottle neck 12. It is understood of course that the configuration of pilfer ring 24 is not critical to the present invention, and numerous pilfer ring structures are presently in use and/or described in the prior art.

Referring again to end wall 14, foamed polymer layer **14*b* is desirably disposed between unfoamed layer 14*a*, which has a thickness comparable to that of side wall 16, and layer 14*c*, which comprises a relatively thin skin of unfoamed polymer. According to one embodiment of the invention, the thickness of unfoamed polymer layer 14*a* is about twice the thickness of unfoamed polymer layer 14*c*, and foamed polymer layer 14*b* is about twice the thickness of unfoamed polymer layer 14*a*. The overall thickness of end wall 14 preferably ranges up to about 0.185 inches (0.47 cm), with a thickness of about 0.125 inches (0.32 cm) being most preferred for carbonated beverage bottle closures manufactured from polypropylene. It is understood, however, that the thickness of end wall 14 and its constituent layers 14*a*, 14*b*, 14*c* can vary depending on the polymeric resin used, the dimensions and geometry of the container, and the and the pressures which the closure must withstand during use. The structure of layers 14*a*, 14*b*, 14*c*** and the manner in which they cooperate in the subject closure are further described and explained in relation to the method by which the layers are made.

Bottle cap 10 preferably comprises a major portion of a moldable thermoplastic resin. Although the resin of choice for a particular use can vary, satisfactory resins for use in making the bottle caps of the present invention can be selected, for example, from olefins, styrenics, polyesters, polycarbonates, or other suitable engineering resins. These and other resins can be employed as homopolymers or can be copolymerized or blended with other constituents as needed for particular applications within the scope of the invention. It is also understood that various additives known by those of skill in the art to be useful for molding thermoplastic compositions can be utilized in the compositions employed to manufacture the subject container closures.

A preferred resin for bottle caps intended for use with carbonated cola beverages is a copolymer of polypropylene and EDPM rubber. One such satisfactory copolymer is marketed by Shell under the tradename WRS 7237. The inclusion of a minor amount of rubber improves the low temperature impact properties of the resin and the resultant bottle cap.

To manufacture a preferred bottle cap of the invention, the thermoplastic resin is desirably combined with minor effective amounts of a nucleator, antioxidant and other additives well known for use in foamed thermoplastic compositions, and then fed into the extruder section of a conventional injection molding machine. A blowing agent is desirably injected under high pressure into the plastified resin within the extruder, after which the mixture is discharged into a mold cavity under sufficient pressure to prevent foaming of the resin around the nucleator sites. Blowing agents useful in making the subject closures can be selected, for example, from nitrogen, carbon dioxide and various commercially available fluorocarbon compounds.

The mold tooling is preferably designed so that when the mold is initially closed, the space within the mold cavity approximately corresponds to the configuration of layers **14*a* and 14*c* of end wall 14, side wall 16, pilfer ring 24 and bridges 28 of bottle cap 10. This is advantageously accomplished with mold tooling comprising a male portion defining the interiorly facing walls and a female portion defining the outwardly facing walls of bottle cap 10. The male portion of the mold tooling is preferably further adapted by means of a retractable insert to slightly increase the volume of that portion of the mold cavity defining end wall 14 during the molding process. As the plastified resin begins to cool within the mold cavity, the insert is retracted, thereby reducing the pressure within that portion of the cavity corresponding to end wall 14 of bottle cap 10 sufficiently to permit the blowing agent to expand. As the insert retracts, the relatively cool boundary layer of resin abutting the retracting surface moves with it, forming layer 14*c* of end wall 14. Behind the boundary layer, the blowing agent causes the thermoplastic resin to expand into the zone of reduced pressure, thereby forming individual cells of foamed polymer about the nucleator sites which, upon completion of cooling, define layer 14*b* of end wall 14. The relative thickness of layers 14*a*, 14*b* and 14*c*** will therefore vary according to the polymer composition, the pressure within the mold cavity before and after retraction of the insert, the degree of cooling prior to and during retraction of the insert, and the distance the insert is retracted.

If the surface of the retractable insert is coextensive with the inwardly facing surface of layer **14*c* of bottle cap 10, layer 14*b* formed by the expansion of resin into the zone of reduced pressure will create a continuous layer of foamed polymer spanning the inside circumference of bottle cap 10. On the other hand, if the surface of the retractable insert is an annulus, layer 14*b* will comprise a circumferentially extending annular "doughnut" of foamed polymer separating layers 14*a* and 14*c* except in the central portion of end wall 14 of bottle cap 10**.

Figure 3:
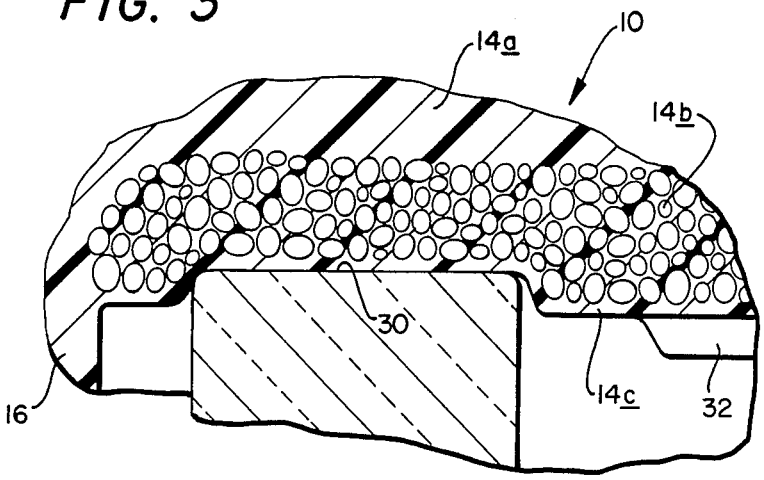
FIG. 3 is a detail view depicting an enlarged portion of the sectional view in FIG. 1 to better illustrate the foamed polymer layer of the invention and the line of contact between the bottle cap and the upwardwardly extending neck of a bottle to which the cap is attached.

Referring to FIGS. 1 and 3, it is seen that when bottle cap 10 is tightly applied to bottle neck 12, top edge 30 of bottle neck 12 exerts force against the surface of layer **14*c* adjacent thereto. This force causes the foamed polymer cells to compress behind that portion of layer 14*c* contacting top edge 30, which is evidenced in FIGS. 1 and 3 by the upward deflection of layer 14*c* adjacent to top edge 30. This effect provides a tight seal between bottle cap 10 and bottle neck 12** as desired.

Figure 2:
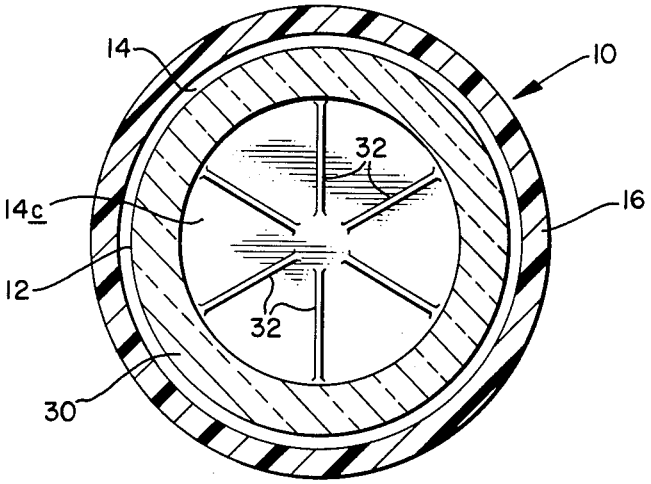
FIG. 2 is a sectional bottom plan view taken along line 2—2 of FIG. 1.

If desired, optional ribs 32 can be incorporated into layer **14*c* of end wall 14 as shown in FIGS. 1 and 2 by providing correspondingly shaped recesses in the face of the of the tool corresponding to the interiorly facing surface of layer 14*c*. Such ribs, which are shown emanating radially from near the center of layer 14*c* in FIG. 2, may assist in further strengthening end wall 14**.

To avoid any appreciable foaming of the polymer in side wall 16 (including threads 18), pilfer ring 24 or bridges 28, it is emphasized that all surfaces of both the male and female halves of the injection molding tooling except the retractable insert remain locked in fixed relation to each other from the time polymer is first injected into the mold cavity until sufficient cooling has occurred to maintain the dimensional stability of those portions of bottle cap 10 outside the mold.

The container closures disclosed herein exhibit highly desirable strength-to-weight ratios and low bulk densities when compared to other unitarily molded polymeric closures. Depending upon the polymer compositions utilized, the geometry of the closure, and the molding apparatus and procedures, closures can be produced that will satisfactorily confine either gaseous or liquid fluids within a container.

Other advantages of the subject bottle cap and various alterations and modifications will become apparent to those of ordinary skill in the art upon reading the present disclosure, and it is intended to cover all such alterations and modifications as fall within the scope of the appended claims.

What is claimed is:

1. A container closure molded from a single polymeric composition, said closure comprising integrally molded polymeric end and side walls, said end wall further comprising a first layer having a density substantially the same as the density of said side wall and a second relatively less dense foamed layer that is formed in situ.

2. The container closure of claim 1, wherein said second layer is disposed between said first layer and a second unfoamed layer of the same polymeric composition.

3. The container closure of claim 1 wherein the major portion of said polymeric composition is a polymer selected from the group consisting of olefins, styrenics, polyesters, and polycarbonates.

4. The container closure of claim 3 wherein said polymeric composition further comprises a blowing agent and a nucleator.

5. The container closure of claim 3 wherein said polymeric composition further comprises a minor amount of a rubber.

6. The container closure of claim 3 wherein said polymer comprises a major portion of polypropylene.

7. The container closure of claim 6 wherein said polymeric composition comprises a major portion of polypropylene and a minor portion of EDPM rubber.

8. The container closure of claim 1 wherein said closure further comprises at least one molded thread for use in attaching said closure to said container.

9. The container closure of claim 1 wherein said second layer is annular.

10. The container closure of claim 1, said closure being further adapted to provide sealing engagement with a bottle neck, said closure comprising a generally circular end wall having a diameter at least as great as the outside diameter of said bottle neck, said end wall comprising an inwardly facing surface adapted to contact the end of said bottle neck; a side wall unitarily molded to said end wall, said side wall further extending circumferentially around said bottle neck; threads unitarily molded to said side wall and adapted to engage threads on the outside of said bottle neck; and a resilient layer of foamed thermoplastic resin formed in situ as a part of said end wall, said resilient layer being adapted to provide a fluid-tight seal between said end wall and the end of said bottle neck when said closure is threadedly engaged with said bottle neck.

11. The closure of claim 10, further comprising a pilfer ring.

12. The closure of claim 10 wherein said resilient layer is annularly shaped and is at least coextensive with the end of said bottle neck.

* * * * *